US005297314A

United States Patent [19]

Bender et al.

[11] Patent Number: 5,297,314

[45] Date of Patent: Mar. 29, 1994

[54] THREE-PIECE LATERAL TAKE-APART DOOR HINGE ASSEMBLY

[76] Inventors: Frederick F. Bender, 9765 Daleview Dr., South Lyon, Mich. 48178; Earl L. Watson, 2560 Canal, Walled Lake, Mich. 48390

[21] Appl. No.: 942,911

[22] Filed: Sep. 10, 1992

[51] Int. Cl.[5] ..... E05D 7/12

[52] U.S. Cl. ..... 16/270

[58] Field of Search ..... 16/270

[56] References Cited

U.S. PATENT DOCUMENTS

| | | | |
|---|---|---|---|
| 1,142,584 | 6/1915 | Krah | 16/270 |
| 4,619,016 | 10/1986 | Brockhaus . | |
| 4,720,895 | 1/1988 | Peebles | 16/264 |
| 4,765,025 | 8/1988 | Salazar | 16/261 |
| 4,766,643 | 8/1988 | Salazar | 16/222 |
| 4,800,623 | 1/1989 | Brockhaus . | |
| 4,807,331 | 2/1989 | Calucci | 16/262 |
| 4,864,687 | 9/1989 | Calcaterra et al. | 16/270 |
| 4,881,298 | 11/1989 | Turnbull . | |
| 5,067,201 | 11/1991 | Marchione | 16/270 |

FOREIGN PATENT DOCUMENTS

| | | | |
|---|---|---|---|
| 578341 | 6/1924 | France | 16/270 |

*Primary Examiner*—John Sipos

*Assistant Examiner*—Carmine Cuda

[57] ABSTRACT

Upper and lower three-piece hinge assemblies enabling a door to be attached and removed in a precise lateral take-apart manner during a vehicle body assembly line operation. Each of the hinge assemblies each provide a body-half mounting hinge and a door-half sub-assembly. The sub-assembly comprises a link plate and a door-half mounting bracket permanently pined together by a door hinge pin. Prior to removably attaching the door-half sub-assembly to the body-half hinge an installer inserts an abutment peg in a through bore of a bracket horizontal wing. The installer then rotates the link plate about its hinge pin until it engages the peg forming, with the bracket, a wedge-shaped receptacle adapted to slidably receive therein a complementary wedge-shaped foot plate of the body-half hinge. The receptacle seats on the foot plate in a predetermined abutting manner enabling each link plate aperture to be self-aligned with an associated foot plate threaded hole. With the tightening of the upper and lower pairs of take-apart screws in each of their respective foot plate threaded holes the upper and lower hinge assemblies are connected in predetermined engagement . Upon removal of the upper and lower pegs the upper and lower hinge assemblies pivotally support the door on the body in a precise manner.

4 Claims, 5 Drawing Sheets

FIG.15
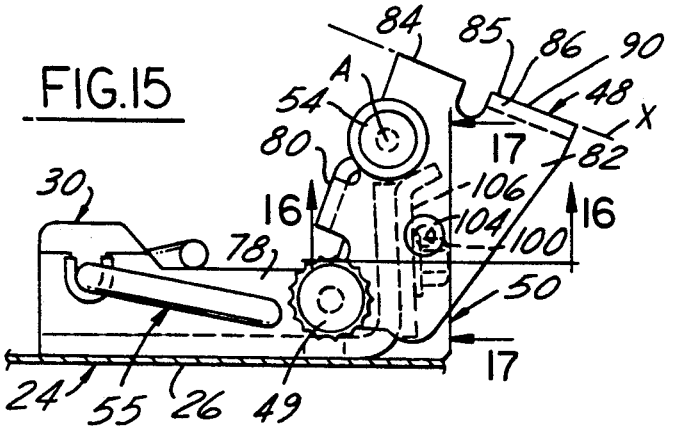
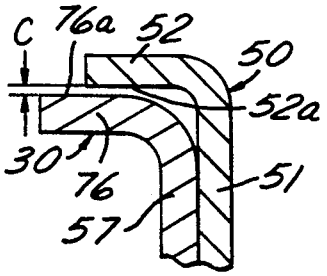
FIG.16A
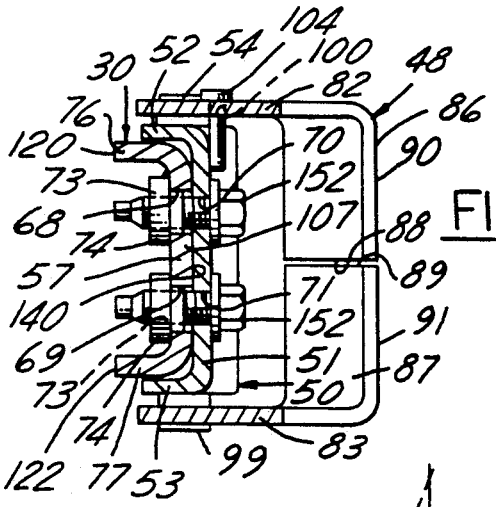
FIG.16
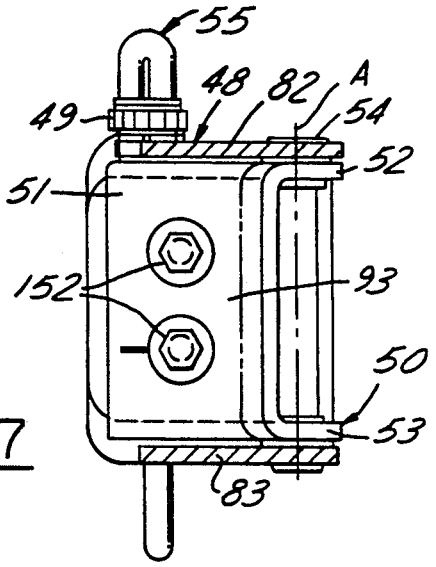
FIG.17
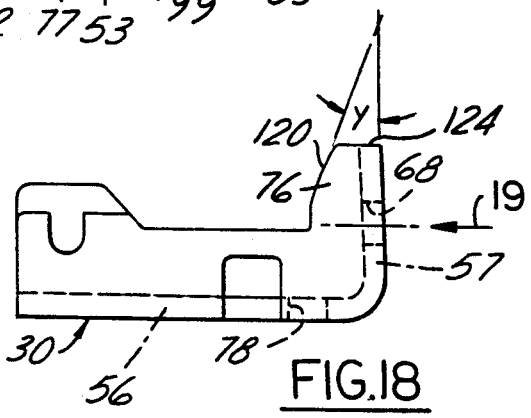
FIG.18
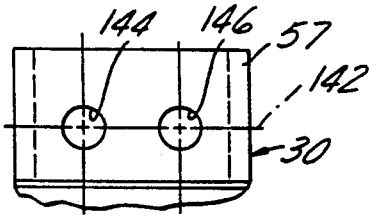
FIG.19
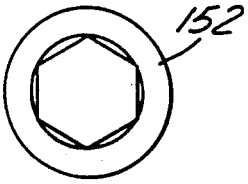
FIG.20
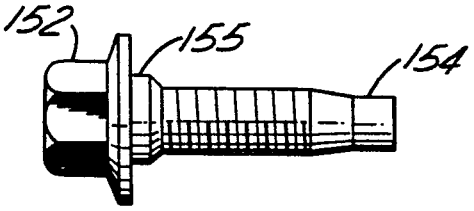
FIG.21

THREE-PIECE LATERAL TAKE-APART DOOR HINGE ASSEMBLY

BACKGROUND AND SUMMARY OF THE INVENTION

This invention relates generally to motor vehicle hinges and, more particularly, to a three piece lateral take-apart hinge assembly suitable for easily mounting a vehicle door enabling ready removal and precise re-mounting of the door as, for example, during a vehicle assembly line operation.

The U.S. Pat. No. 4,720,895 issued Jan. 26, 1988 to Russell H. Peeples entitled Quick-Disconnect Door Hinge discloses a door hinge assembly enabling the vehicle doors to be quickly removed and reassembled during the assembly advancement of the vehicle body. The Peeples hinge body half comprises a main member and a U-shaped extension member. The main member includes a flat mounting plate portion and a channel shaped angled portion bent outwardly from the plate portion. The U-shaped extension member has a planar base portion provided with right angled side flanges defining a pair of parallel legs each terminating in a hinge knuckle. The main member angled portion is sized for snug nested reception of the U-shaped extension member. An aperture is provided in the extension member base wall aligned with an aperture in the main member channel shaped portion bight wall. Upon tightening a threaded bolt in the aligned apertures the juxtaposed surfaces of the members are adapted for mutual clamped abutment preventing both separation and relative rotation thereof.

The U.S. Pat. No. 4,766,643 issued Aug. 30, 1988 to Sumorfin Salazar entitled Vehicle Door Hinge Having Vertically Separable Pivotal Connections. The Salazar patent discloses a lift-off vehicle door hinge mounting arrangement for a vehicle door in which one of two vertically spaced hinges is the type that permits separation of the part connected to the vehicle body from the type connected to the door through lifting one with respect to the other. In one form of the Salazar patent a modified hinge body mounting plate has an apertured upstruck abutment tab aligned with an aperture in a door mounting plate. A shank portion of a plastic push pin is snugly received in the aligned apertures.

It is an object of the present invention to provide upper and lower three-piece door hinge assemblies enabling a vehicle door and its upper and lower door-half hinge sub-assemblies to be readily removed and re-mounted in a lateral manner while insuring an exact fit of the re-mounted door with the vehicle body.

It is another object of the present invention to provide a three-piece door hinge assembly as set forth above wherein the door-half hinge sub-assembly comprises a door-half hinge bracket, adapted to be fixedly attached to the door, and a link plate pivotally connected to the door-half mounting bracket wherein the link plate is readily pivoted to a preset door partially open position where it abuts a locating push-pin temporarily inserted in the hinge bracket prior to door removal.

It is a further object of the present invention to provide a three-piece door hinge assembly as set forth above wherein the locating push-pin establishes a predetermined door open position between the link plate and the door-half bracket creating a wedge-shaped receptacle, formed by cooperation of a vertical link plate surface angularly oriented relative to a vertical surface of the bracket, which receptacle is open toward the body-mounting hinge and adapted to slidably receive therein a complementary body-half hinge wedge-like foot plate in a lead-in nested manner.

It is a still further object of the present invention to provide a three-piece door hinge assembly as set forth above wherein the wedge-like foot plate and the door-half sub-assembly wedge-shaped receptacle have abutting stop portions. A pair of threaded holes in the foot plate are thereby automatically aligned with associated apertures in the link plate for the ready reception and tightening of take-apart screws by an assembly line operator. Thus, the link plate and foot plate are positively clamped together insuring parallelism of the door-half hinge subassembly with the body-half hinge.

BRIEF DESCRIPTION OF THE DRAWINGS

These and other features and advantages of the present invention will appear from the following written description and accompanying drawings in which:

FIG. 15 is a fragmentary top plan view of the hinge assembly of FIG. 13;

FIG. 16 is a vertical sectional view, partly in elevation, taken substantially on the line 16—16 of FIG. 15;

FIG. 16A is an enlarged fragmentary view showing the upper flange spacing of FIG. 16.

FIG. 17 is a vertical sectional view taken on the line 17—17 of FIG. 15;

FIG. 18 is a detail top plan view of the body-half mounting plate of FIG. 15;

FIG. 19 is a fragmentary end plan view taken in the direction of arrow denoted "FIG. 19" of FIG. 18;

FIG. 20 is an enlarged top plan view of a take-apart shoulder bolt of the present invention; and FIG. 21 is an enlarged side view of the take-apart shoulder bolt of FIG. 20.

DESCRIPTION OF THE INVENTION

Figure 1:
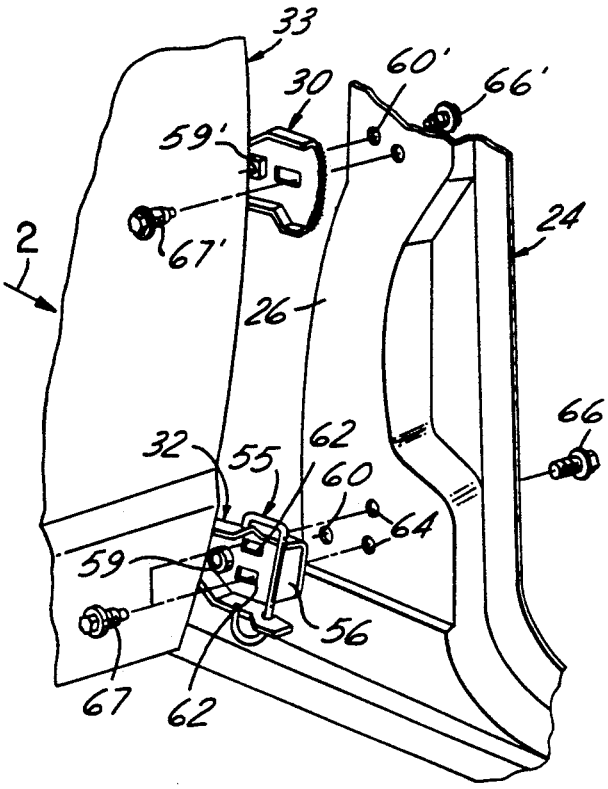
FIG. 1 is a fragmentary, exploded, perspective view looking toward the rear exterior of a four door vehicle showing a right hand rear door and its upper and lower hinge assemblies in accordance with the present invention.
Figure 2:
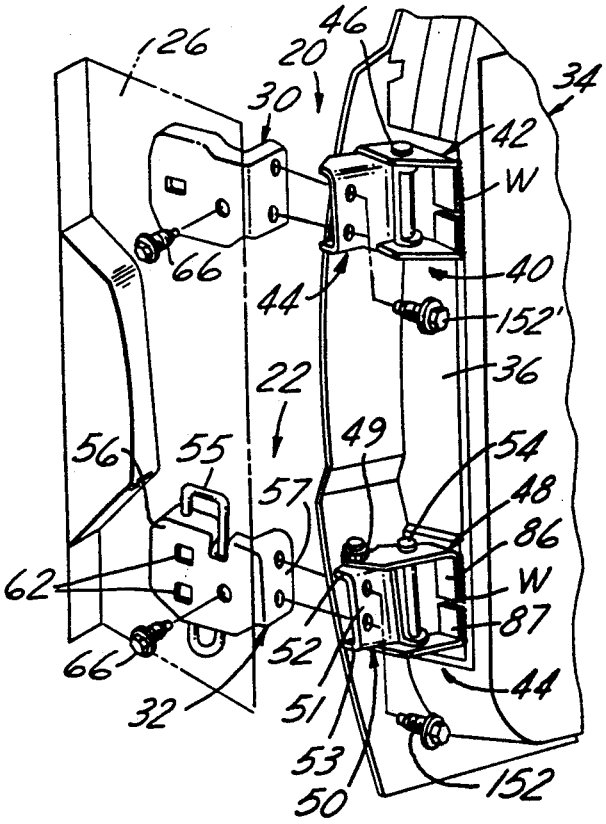
FIG. 2 is a fragmentary perspective view, looking toward the front interior of the FIG. 1 vehicle upper and lower hinge assembly with the right hand rear door and its door half hinge sub-assemblies laterally removed from the vehicle body-half hinge plates.

Referring now to the drawings, FIGS. 1 and 2 depict exploded views of upper 20 and lower 22 three-piece lateral take-apart hinge assemblies in accordance with the present invention. The hinges are shown adapted to be secured to a portion of a vehicle body hinge pillar 24 including an upright hinge mounting upright panel 26. The hinge assemblies 20 and 22 are shown in conjunction with a "B" pillar 24 supporting the right-hand one of a pair of vehicle rear doors. It will be appreciated that the hinge assemblies of the present invention are adapted for use with other vehicle doors, such as front door supported on a vehicle "A" pillar, for example, without departing form the spirit of the present invention.

Figure 3:
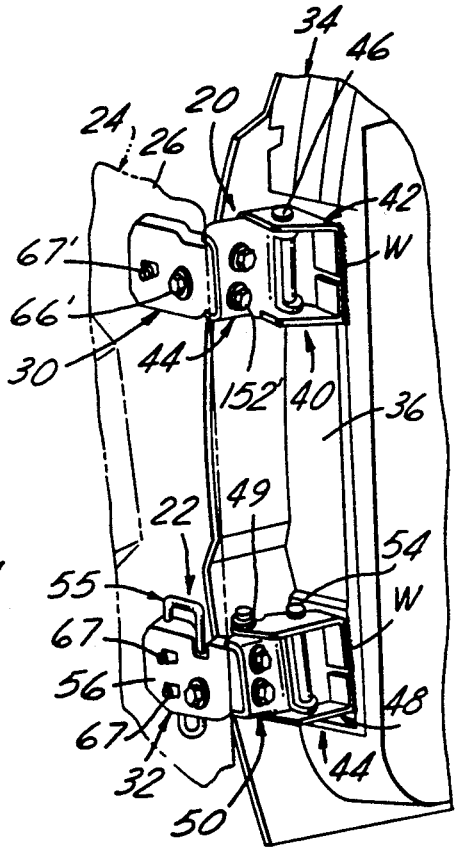
FIG. 3 is view similar to FIG. 2 showing the door hinge sub-assemblies pivotally attached to the vehicle body hinge plates.

In FIG. 1, the upright body panel 26 is shown adapted to fixedly support by suitable fasteners a body-half mounting hinge 30 of the upper hinge assembly 20 and a body-half mounting hinge 32 of the lower hinge assembly 22. With reference to FIGS. 1-3, the upper and lower three-piece hinge assembles 20 and 22 are shown mounting a vehicle rear door 33 to the hinge panel 26. The vehicle door 34 has upper and lower door-half sub-assemblies suitably affixed to door panel 36 in a manner to be explained below.

The upper hinge assembly 20 comprises an upper door-half sub-assembly 40 together with its upper body-half mounting hinge 30. The upper door-half sub-assembly 40 includes an upper door-half mounting bracket 42 and an upper pivot link plate 44 swingably connected together by upper pivot pin 46. In a like manner, the lower hinge assembly 22 comprises a door-half sub-assembly 44 including a lower door-half mounting bracket 48 and a lower pivot link plate 50. As the upper and lower door-half sub-assemblies are substantially identical in structure and are installed in the same manner, only the lower three-piece hinge assembly 22 will be discussed in detail.

Figure 11:
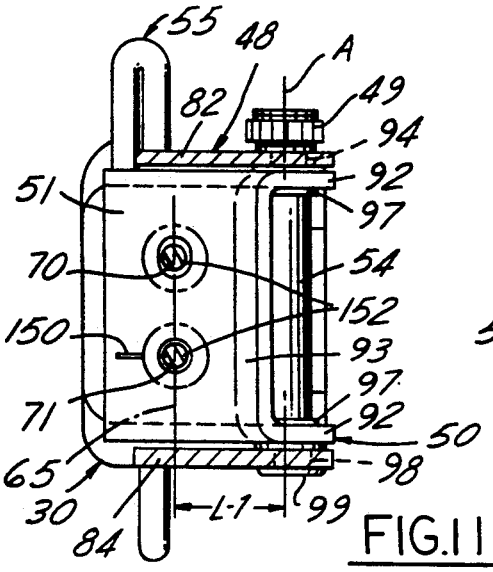
FIG. 11 is a vertical sectional view, partly in elevation, taken on the line 11—11 of FIG. 10.
Figure 12:
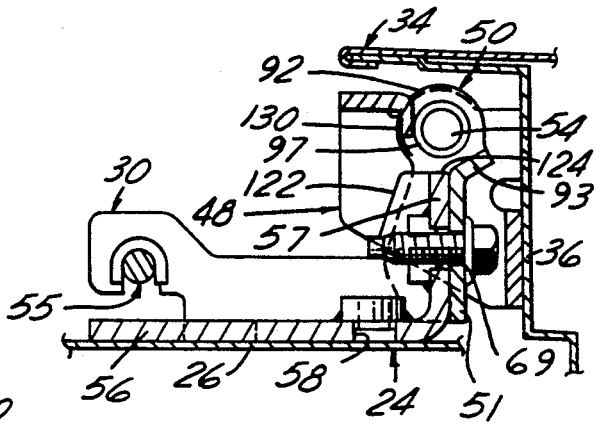
FIG. 12 is a horizontal cross sectional view taken in the plane of the line 12—12 of FIG. 10.
Figure 13:
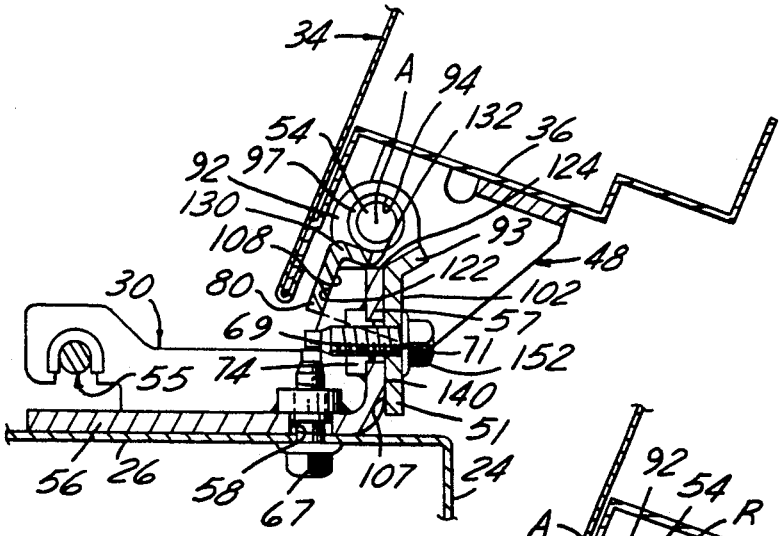
FIG. 13 is a cross sectional view similar to FIG. 12 showing the lower right-hand hinge assembly in an intermediate or partially open position adapted for door removal.

As best seen in FIGS. 11, 12, and 13, the link plate member 50 comprises a link plate 51 having a pair of upper and lower right-angle flanges 52 and 53. The door-half mounting bracket 48 and the link plate member 50 are swingably connected together by lower pivot pin 54. The structure of the both the upper 20 and lower 22 three-piece hinge assemblies are the same except that the lower hinge assembly 22 incorporates a conventional hold-open torsion bar 55 and detent roller 49 arrangement. Reference numbers denoting the bolts in the upper hinge assembly 20 are the same as the corresponding bolts in the lower hinge assembly 22 except that they have been primed.

Figure 6A:
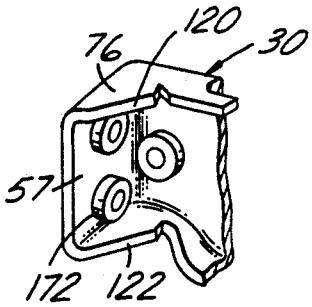
FIG. 6A is a fragmentary perspective detail view of the wedge-shaped foot sector of the body-half hinge member.
Figure 6:
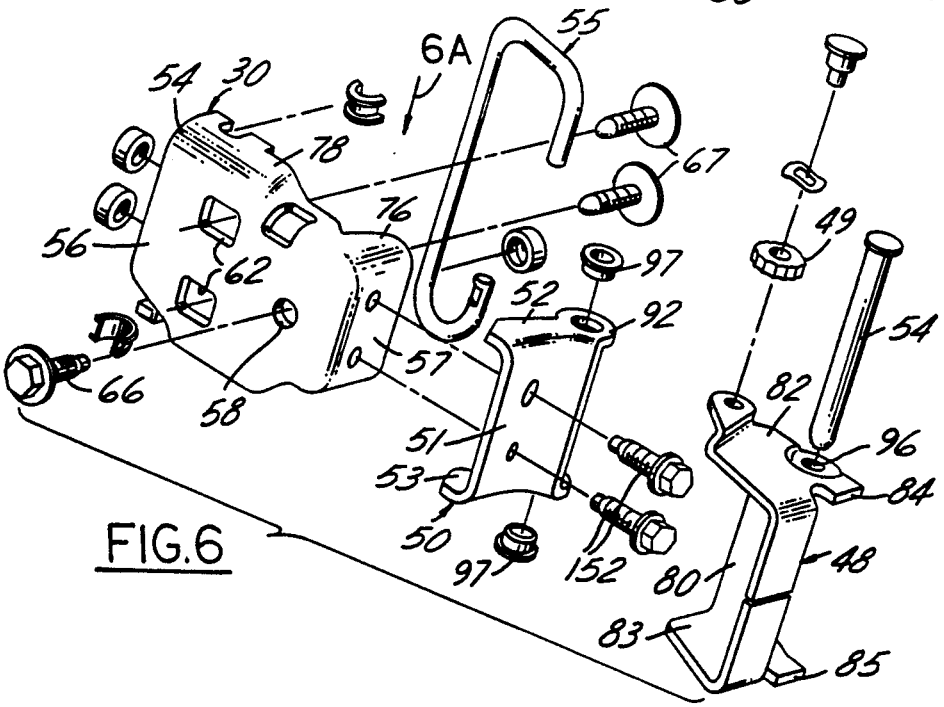
FIG. 6 is an exploded perspective detail view of the lower three-piece hinge assembly of FIGS. 3, 4, and 5.
Figure 7:
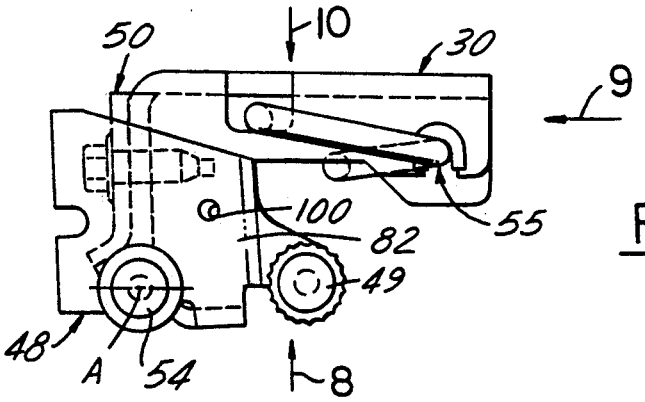
FIG. 7 is a view from above of the hinge assembly of FIG. 4 shown in its door closed position.
Figure 8:
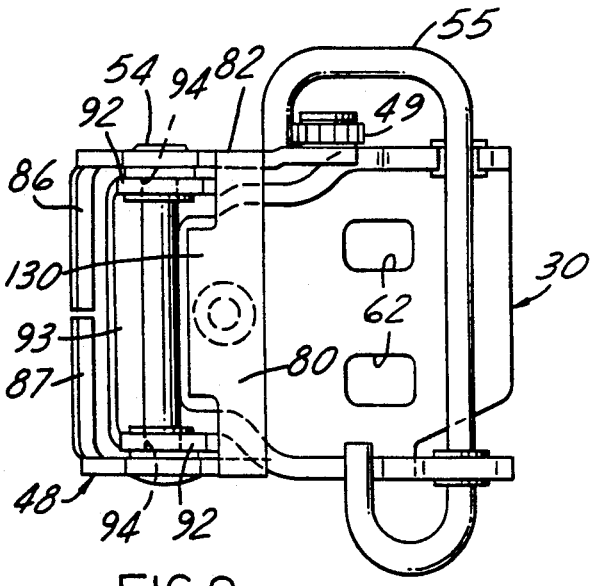
FIG. 8 is a side plan view looking in the direction of arrow "FIG. 8" of the hinge assembly of FIG. 7.
Figure 9:
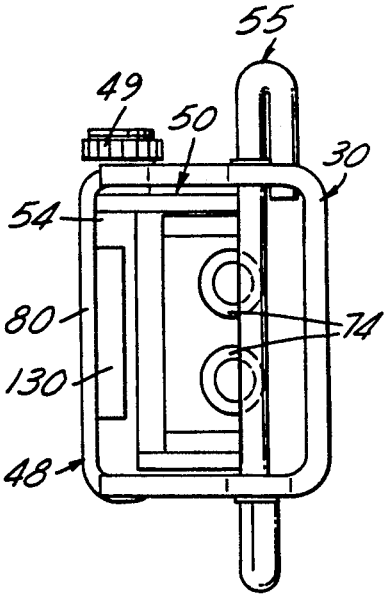
FIG. 9 is an end plan view looking in the direction of arrow "FIG. 9" of FIG. 7.
Figure 10:
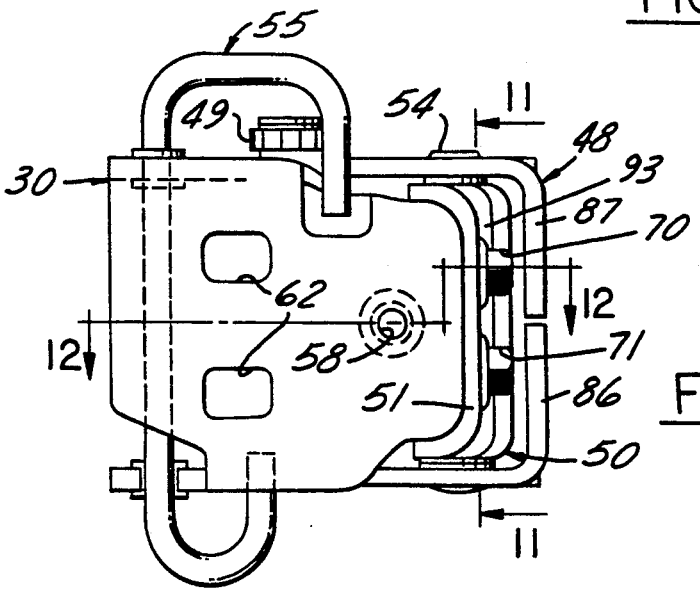
FIG. 10 is a side plan view looking in the direction of arrow "FIG. 10" of FIG. 7.

With reference to FIGS. 6 and 18, it will be seen that the lower body-half mounting hinge 30 is L-shaped in horizontal section providing a body mounting leg plate 56 and a foot plate 57. The leg plate 56 has an attachment hole 58 and staked nut 59 for alignment with a panel hole 60 by bolt 61 (FIG. 1). As seen in FIG. 1, the leg plate 56 also has a pair of elongated slots 62 for alignment with a pair of panel mounting holes 64. In the disclosed embodiment, a threaded machine screw 66 is pre-assembled in the panel staked nut 59 and aligned hole 60 while the slots 62 are adapted to receive threaded shoulder bolts 67 by an assembly line installer.

As disclosed in FIG. 16, the body-half lower mounting hinge foot plate 57 has through holes, 68 and 69 aligned on a common vertical centerline 65 (FIG. 11) spaced from the hinge axis "A" by a predetermined dimension L-1. Link plate 50 is provided with an upper slot 70 and a lower hole 71 also aligned on centerline 65 for a reason to be explained. Internally threaded bores 73 of an associated pair of stake nuts 74 are aligned on the vertical centerline 65 with the stake nuts 74 suitably attached to the inner surface of the foot plate 57.

Figure 4:
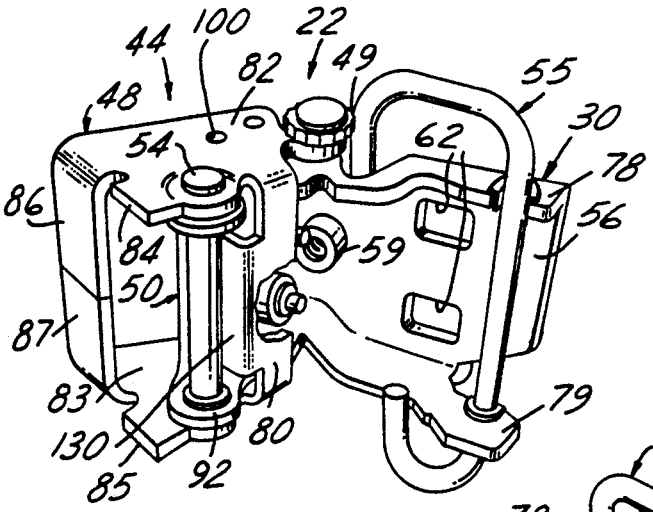
FIG. 4 is an enlarged perspective view showing the lower three-piece hinge assembly of FIG. 1 from the outside in its door open mode.

It will be appreciated in FIGS. 4 and 16 that both the leg plate 54 and the foot plate 56 are channel-shaped in vertical section providing upper 76 and lower 77 horizontal right-angle flanges for the foot plate and corresponding upper 78 and lower 79 horizontal right-angle flanges (FIG. 4) for the leg plate 56. It will be further observed in FIG. 16 and FIG. 16*a* that the link plate upper 52 and lower 53 flanges are vertically spaced a predetermined dimension greater than the foot plate flanges 76 and 77 enabling the foot plate flanges 6 and 77 to nest in a slightly spaced manner between the link plate flanges 52 and 53. As a result, the outer surface 140 of the foot plate is adapted for ready flush contact with the opposed inner surface 107 of the link plate. The upper flange spacing is indicated in FIG. 16A by the predetermined upper dimensional clearance "C" provided between outer face 76*a* of the foot plate upper flange 76 and inner opposed face 52*a* of the link plate upper flange 52.

Figure 5:
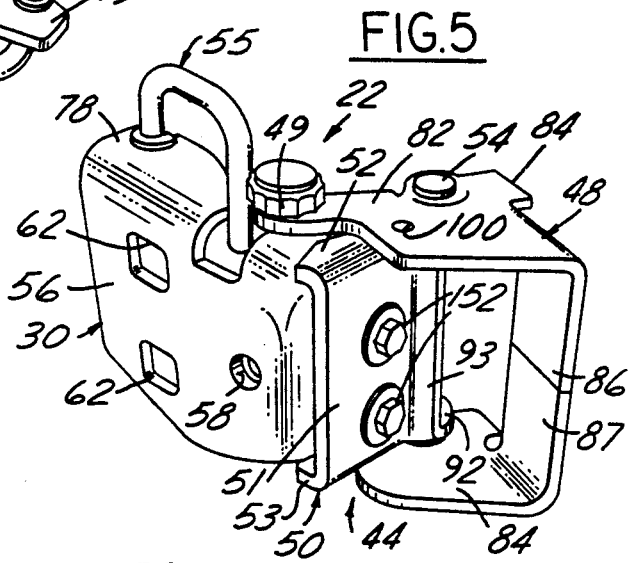
FIG. 5 is a enlarged perspective view showing the showing the opposite side of lower hinge assembly.

With reference to FIGS. 5, 6, and 16, the lower door-half sub-assembly mounting bracket 48 is generally U-shaped in vertical section defining a vertically disposed strap portion 80 and a pair of upper 82 and lower 83 horizontally disposed bracket wings. As best seen by the upper wing 82 in FIG. 15, the wings have a generally quadrilateral-shape in elevation. FIG. 4 shows each of the wings 82, 83 having respective upper 84 and lower 85 co-planar inboard side edge portions, disposed at right-angles to strap portion 80, and respective upper 86 and lower 87 co-planar outboard web sections 86 and 87. It will be noted in FIG. 16 that the web portions free horizontal opposed adjacent edges 88 and 89 define a narrow clearance space therebetween. It will be further be seen in FIG. 15 that the inboard side edges 84 and 85 define a vertical plane, defined by dashed construction line "X", that includes the outboard surfaces 90 and 91 of their respective flange sections 86 and 87. Thus, the door-half mounting bracket 42 is seated in a flush manner on the door support panel 36, as seen in FIG. 3, enabling it to be fixedly connected thereto by edge welds "W".

As best seen in FIGS. 11-14, the link plate member 50 has each of its upper and lower flanges 52 and 53 formed with associated upper and lower apertured knuckles 92 at one vertically extending angled flanged end 93 of the link plate member. The angled flanged end 93 stiffens the link plate upper and lower knuckles enabling the pair of knuckles 92 to provide aligned holes 94 for reception of hinge pin 54. Upon the hinge pin 54 being inserted in the door-half mounting bracket upper wing hole 96, the pin 54 is received in aligned journal bearings 97 in the knuckle holes 94 prior to insertion of the pin through hole 98 in the lower bracket wing 83. The hinge pin 54 is locked by suitable means such as the lower end of hinge pin 54 being upset as seen at 99 in FIG. 11.

Figure 14:
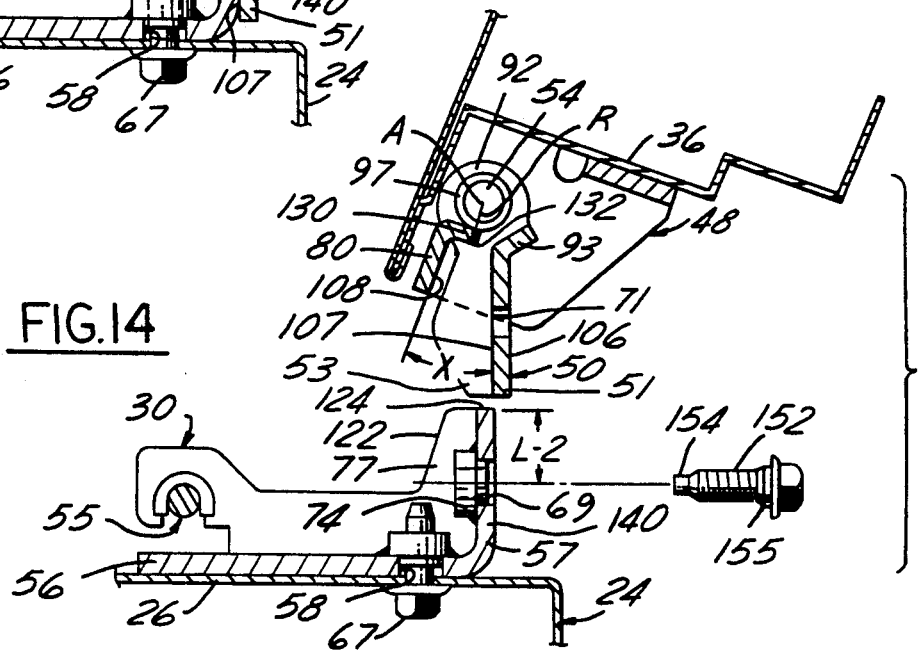
FIG. 14 is a view similar to FIG. 13 showing the pair of take-apart bolts removed and the door laterally separated from the body.

FIG. 14 shows the door lower door-half mounting hinge sub-assembly 40 positioned for installation upon the body panel 26. Each upper and lower door-half mounting hinge sub-assembly link plate member, such as link plate member 50 is rotated about its hinge pin 52 to a predetermined intermediate lateral take-apart position shown in FIGS. 13. This pre-positioning of the link plate member 50 is achieved by the operator inserting a locating push-pin or cylindrical peg 104 in bracket wing through bore 100 as seen in FIG. 16. It will be noted in FIG. 15 that the push-pin or peg 104 locates the link plate 50 at a predetermined intermediate lateral take-apart or install position by establishing line contact abutment with the outer surface 106 of the link plate 51. The peg 104 thus positions link plate outer surface 106 tangent with the upper wing cylindrical reference bore 100.

It will be seen in FIG. 14 that with the peg 104 inserted in its bore 100 link plate inner surface 107 defines a predetermined acute dihedral angle "X" with opposed inner surface 108 of the door-half mounting bracket strap 80. The opposed angled inner surfaces 107 and 108 cooperate to provide a wedge-shaped receptacle or socket sized to slidably receive the wedge-shaped foot plate 57 in a snug lead-in manner, as seen in FIG. 13. In FIGS. 18 and 22, the foot plate upper and lower flanges 76 and 77 are shown having their edges 120 and 122 (FIG. 14), respectively, tapered toward their common free vertical stop edge 124 at a predetermined external acute angle "Y" (FIG. 18) equal to internal acute angle "X" in FIG. 13.

With reference to FIG. 4, 8, 9 and 13, the body-half bracket strap 80 is shown formed with an inwardly angled leaf 130 extending at substantially right angles to the strap 80 with its outer face 108 closely adjacent to the hinge pin 54. It will be seen in FIG. 14 that the leaf 130 defines a free vertical line-edge or corner juncture 132 spaced a predetermined radial dimension "R" from hinge pivot axis "A".

FIG. 14 shows the door-half hinge sub-assembly wedge-shaped receptacle, defined by inner link plate surface 107 and the opposed inner strap surface 108, opening outwardly to receive the wedge-shaped flanged foot plate 57 as best seen in FIG. 6A.

Upon an installer fitting a push-in peg 102 in the aperture 100 of each upper 44 and lower 50 link plate, the link plate member 50 is rotated to its lateral door install or take-apart position. The installer installs the door 34 on the vehicle pillar 24 by inserting each upper and lower body-half foot plate 57 in the outwardly facing opening of the wedge-shaped receptacle. The foot-plate tapered upper and lower flange edges 120 and 122 (FIG. 6A) slidably contact the strap inner surface 108 while foot plate outer surface 140 slidably contacts the link plate inner surface 107 until vertical stop edge 124 engages mating bracket strap line edge 132 as seen in FIG. 13. The line-edge 132 is located the predetermined radial dimension "R" from the hinge axis "A" and the stop edge 124 is located a predetermined dimension "L-2" from the center line 72. Thus, it will be seen that upon mated contact of the stop edge 124 with the line-edge 132 the link plate fastener centerline 72 is aligned with the vertical centerline 142 of a pair of vertically spaced through bores 144 and 146 in the foot plate (FIG. 19).

It will be seen in FIG. 11 that the link plate lower circular hole 71 is denoted by an inscribed line 150. To fasten the link plate to the foot plate the installer initially inserts a first take-apart shoulder bolt 152 in the designated link plate lower hole 71. The shoulder bolt 152 has a shoulder 155 which nests to link plate hole slot 70 and hole 71. The bolt's piloted end 154 is received in aligned hole 146 of the foot plate and the installer threadably tightens the bolt in the lower nut 74. A second shoulder bolt is inserted in the upper elongated slot 70 which allows for vertical self-adjustment of any slight dimensional out-of-tolerance between the foot plate pair of holes 144 and 146 with their aligned link plate vertical slot 70 and circular hole 71, respectively.

Although only one embodiment of the invention has been illustrated and described, it is apparent that modifications and variations will readily come to mind of a person skilled in the art which modifications and variations do not fall outside the scope of the invention as defined by the following claims.

I claim:

1. In combination, an arrangement for laterally removing and re-mounting a door to a vehicle body, said arrangement including upper and lower three-piece separable hinge assemblies, each said hinge assembly comprising:

a door-half sub-assembly and a body-half mounting hinge, said door-half sub-assembly comprising a door mounting bracket and a link plate, said door mounting bracket adapted to be secured to the vehicle door and said body-half hinge plate adapted to be secured to the vehicle body and pivotally connected by a hinge pin about a vertical hinge axis to said link plate;

said body-half mounting hinge being generally L-shaped in horizontal section providing a leg plate and a foot plate such that said leg plate adapted to be secured to the vehicle body and said foot plate generally channel-shaped in vertical section providing upper and lower flanges and a vertical free stop edge;

said link plate having vertically spaced upper and lower apertures aligned on a common vertical centerline adapted for paired alignment with upper and lower threaded holes in said foot plate, such that a take-apart screw extends through each said link plate aperture for threaded engagement in an associated foot plate threaded hole;

one of said link plate apertures being slightly elongated along said vertical centerline and the remaining aperture having a predetermined circular dimension, said link plate remaining aperture adapted for alignment with an associated one of said foot plate threaded holes and adapted for initial reception of a first take-apart shouldered screw, and whereby a second take-apart shoulder screw adapted for subsequent reception in said elongated aperture and its aligned foot plate threaded hole;

said door-half mounting bracket being generally U-shaped in vertical section having an upright strap portion formed with upper and lower right-angle horizontal wings projecting outwardly therefrom, a pivot hole in each said wing vertically aligned on said hinge axis and receiving a hinge pin therethrough, said strap portion having one vertical inboard edge formed with an inwardly angled leaf adjacent said hinge pin, said angled leaf having a vertically disposed line-edge stop spaced a predetermined dimension from said hinge axis;

said door-half mounting bracket upper and lower wings spaced a predetermined dimension for receiving said link plate therebetween, said link plate formed with upper and lower horizontally disposed apertured knuckles on one inboard end aligned with said wing pivot holes whereby said pair of wing pivot holes and said knuckle apertures receiving said hinge pin therethrough such that said link plate pivots intermediate said wings relative to said door-half mounting bracket;

a locating bore formed at a predetermined location in one of said wings, said locating bore adapted to receive a locating peg therethrough prior to pivoting the door outwardly from a closed position such that said peg engages an outer face of said link plate locating the door at a predetermined full open take-apart position;

with said door in said take-apart position said link plate inner face and an opposed inner face of said door-half mounting bracket strap portion provide a wedge-shaped receptacle, said wedge-shaped receptacle being open for reception of said body-half foot plate, said foot plate having a wedge-shape adapted for complementary insertion in said wedge-shaped receptacle;

whereby said upper and lower hinge assemblies enabling a removed door to be laterally remounted on the vehicle body by virtue of each upper and lower wedge-shaped receptacle receiving, in a guided manner, an associated wedge-shaped foot such that each said plate stop edge contacts its associated door-half line-edge stop thereby laterally aligning each said upper and lower foot plate threaded hole with an associated link plate one elongated aperture and said remaining circular aperture, such that upon initial insertion and tightening of a first take-apart screw in each said link plate circular aperture and its associated foot plate threaded hole, and subsequent insertion and tightening of a second take-apart screw in each said link plate elongated aperture and its associated foot plate threaded hole, thereby permitting self-adjustment of said second screw to compensate for slight off-centering of said pair of line plate apertures with their associated pair of foot plate threaded holes, whereby each said upper and lower foot plate and associated upper and lower line plate are positively clamped together insuring exact fit of said door in said body door opening.

2. The three-piece lateral take-apart hinge arrangement as set forth in claim 1 wherein with said door in said take-apart position and said link plate inner face and an opposed inner face of said door-half mounting bracket strap portion provide a wedge-shaped receptacle, whereby said strap and link plate inner faces create a predetermined dihedral angle, said wedge-shaped receptacle being open for reception of said body-half foot plate.

3. The three-piece lateral take-apart hinge arrangement as set forth in claim 2 wherein said foot plate flanges having upper and lower flange edges thereof tapered toward said vertical free stop edge of said foot plate, said flange tapered edges defining a common vertical plane which intersects a vertical outer face plane of said foot plate at an acute angle substantially equal to said predetermined dihedral angle.

4. The three-plate lateral take-apart hinge arrangement as set forth in claim 3 wherein each said upper and lower wedge-shaped receptacle receiving in a guided manner, as associated foot plate outer surface in flush contact with its link plate inner face while its associated foot plate pair of tapered flange edges engage a mating inner surface of its associated strap portion and each foot plate stop edge contacts it associated door-half line-edge thereby laterally aligning each said foot plate pair of upper and lower foot plate threaded holes with an associated link plate aperture.

* * * * *

UNITED STATES PATENT AND TRADEMARK OFFICE

CERTIFICATE OF CORRECTION

PATENT NO. : 5,297,314

DATED : March 29, 1994

INVENTOR(S) : Frederick F. Bender, et. al.

It is certified that error appears in the above-indentified patent and that said Letters Patent is hereby corrected as shown below:

Title page, item [73], Assignee: should be-- Chrysler Corporation--

Title page, item [56], under Foreign Patent Documents, col. 2, line 1, add -- Attorney, Agent, or Firm: Edward P. Barthel--.

Signed and Sealed this

Nineteenth Day of July, 1994

*Attest:*

*Attesting Officer*

BRUCE LEHMAN

*Commissioner of Patents and Trademarks*